US011219305B1

(12) United States Patent
Johnson

(10) Patent No.: US 11,219,305 B1
(45) Date of Patent: Jan. 11, 2022

(54) MOBILE DESK ASSEMBLY

(71) Applicant: Jonathan Johnson, Washington, DC (US)

(72) Inventor: Jonathan Johnson, Washington, DC (US)

( * ) Notice: Subject to any disclaimer, the term of this patent is extended or adjusted under 35 U.S.C. 154(b) by 0 days.

(21) Appl. No.: 17/078,246

(22) Filed: Oct. 23, 2020

(51) Int. Cl.

| | |
|---|---|
| ***A47B 3/14*** | (2006.01) |
| ***A47B 13/02*** | (2006.01) |
| ***A47B 91/00*** | (2006.01) |
| ***A47B 13/08*** | (2006.01) |
| *A47B 83/02* | (2006.01) |

(52) U.S. Cl.
CPC ..... *A47B 3/14* (2013.01); *A47B 13/023* (2013.01); *A47B 13/081* (2013.01); *A47B 91/002* (2013.01); *A47B 2083/025* (2013.01); *A47B 2200/004* (2013.01); *A47B 2200/0072* (2013.01)

(58) Field of Classification Search
CPC ..... A47B 3/14; A47B 2003/145; A47B 39/02; A47B 39/04
USPC ..... 297/159.1, 170, 173, 169; 108/43, 44
See application file for complete search history.

(56) References Cited

U.S. PATENT DOCUMENTS 2,115,497 A * 4/1938 Mintz ..... A47B 39/02 248/185.1
2,168,910 A * 8/1939 Merrill ..... A47B 39/02 297/172
2,673,595 A * 3/1954 Kump, Jr. ..... A47B 39/04 297/172
4,798,411 A * 1/1989 Lin ..... A47B 3/14 297/170
4,892,352 A 1/1990 Haywood
5,263,423 A * 11/1993 Anderson ..... F16M 11/38 108/43
5,893,607 A 4/1999 Trimnell
5,927,815 A * 7/1999 Nakamura ..... F16C 11/106 297/411.38
5,961,179 A 10/1999 Dixon
5,988,738 A 11/1999 Blessing
6,062,145 A * 5/2000 Lin ..... B60N 3/005 108/44
6,543,853 B1 * 4/2003 Splane, Jr. ..... A47C 9/005 297/195.11
7,314,248 B2 1/2008 Mabon
8,104,828 B2 1/2012 Knighton
(Continued)

FOREIGN PATENT DOCUMENTS

DE 202021000435 U1 * 3/2021 ..... A47C 7/38
WO WO-2016081857 A1 * 5/2016 ..... A47B 9/20
WO WO-2019122467 A1 * 6/2019 ..... A47B 41/02

*Primary Examiner* — Jose V Chen

(57) ABSTRACT

A mobile desk assembly for provision of a mobile and transportable workstation includes a first leg, which is positioned between a pair of first plates and engaged thereto by a plurality of first pins so that the first plates bracket the first leg. A seat is engaged to a first end of the pair of first plates. A rod is engaged via a first pivot pin to the first plates, proximate a second end thereof. A pair of second legs is hingedly engaged to the rod distal from the first plates. The first leg, the rod, and the second legs are selectively positionable in a deployed (tripodal) and a collapsed configurations. The first and second legs each have a wheel rotationally engaged thereto. A panel engaged to an upper terminus of the first leg is substantially parallel to the surface and can support an article positioned thereupon.

15 Claims, 6 Drawing Sheets

(56) References Cited

U.S. PATENT DOCUMENTS

| | | | | |
|---|---|---|---|---|
| 8,104,835 | B2 * | 1/2012 | Ovre | A61G 5/127 297/340 |
| 8,567,808 | B2 | 10/2013 | Tholkes | |
| D803,589 | S | 11/2017 | Rehkemper | |
| 10,117,510 | B2 | 11/2018 | Rehkemper | |
| 2006/0197362 | A1 * | 9/2006 | Mabon | A47C 3/20 297/172 |
| 2010/0117406 | A1 * | 5/2010 | Knighton | A47C 9/022 297/142 |
| 2013/0313868 | A1 * | 11/2013 | Dickey | A47B 39/06 297/135 |
| 2017/0273451 | A1 * | 9/2017 | Jeanphilippe | A47C 4/24 |
| 2019/0191869 | A1 * | 6/2019 | Pensack | F41H 5/06 |

* cited by examiner

MOBILE DESK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to desk assemblies and more particularly pertains to a new desk assembly for provision of a mobile and transportable workstation.

(2) Description of Related Art Including Information Disclosed Under 37 CFR 1.97 and 1.98

The prior art relates to desk assembles. Prior art desk assembles may comprise foldable desks, foldable desks having a pair of wheels engaged thereto for rolling the desk when folded, desks having two legs, and desks having a plurality of castors or wheels engaged thereto. What is lacking in the prior art is a tripodal foldable desk having wheels that allow locomotion of the desk and a user seated thereat.

BRIEF SUMMARY OF THE INVENTION

An embodiment of the disclosure meets the needs presented above by generally comprising a first leg, which is positioned between a pair of first plates and which has a wheel rotationally engaged thereto proximate to a lower terminus thereof. A plurality of first pins is engaged to and extends between the first plates so that the first plates are engaged to and bracket the first leg. A seat is engaged to a first end of the pair of first plates.

A rod is engaged via a first pivot pin to the first plates, proximate a second end thereof, so that the rod is pivotally engaged to the first plates. A pair of second legs is hingedly engaged to the rod distal from the pair of first plates. The first leg, the rod, and the second legs are selectively positionable in a deployed configuration and a collapsed configuration. In the deployed configuration, the rod extends linearly from the pair of first plates and the second legs extend transversely from the rod. In the collapsed configuration, the second legs extend in parallel from the rod and the rod is substantially parallel to the first leg. Each second leg has a wheel rotationally engaged thereto distal from the rod. The wheels are configured to allow locomotion across a surface.

A panel is engaged to an upper terminus of the first leg. The panel is substantially parallel to the surface when the first leg, the rod, and the second legs are in the deployed configuration. The panel is rigid and thus is configured to have an article positioned upon an upper face thereof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
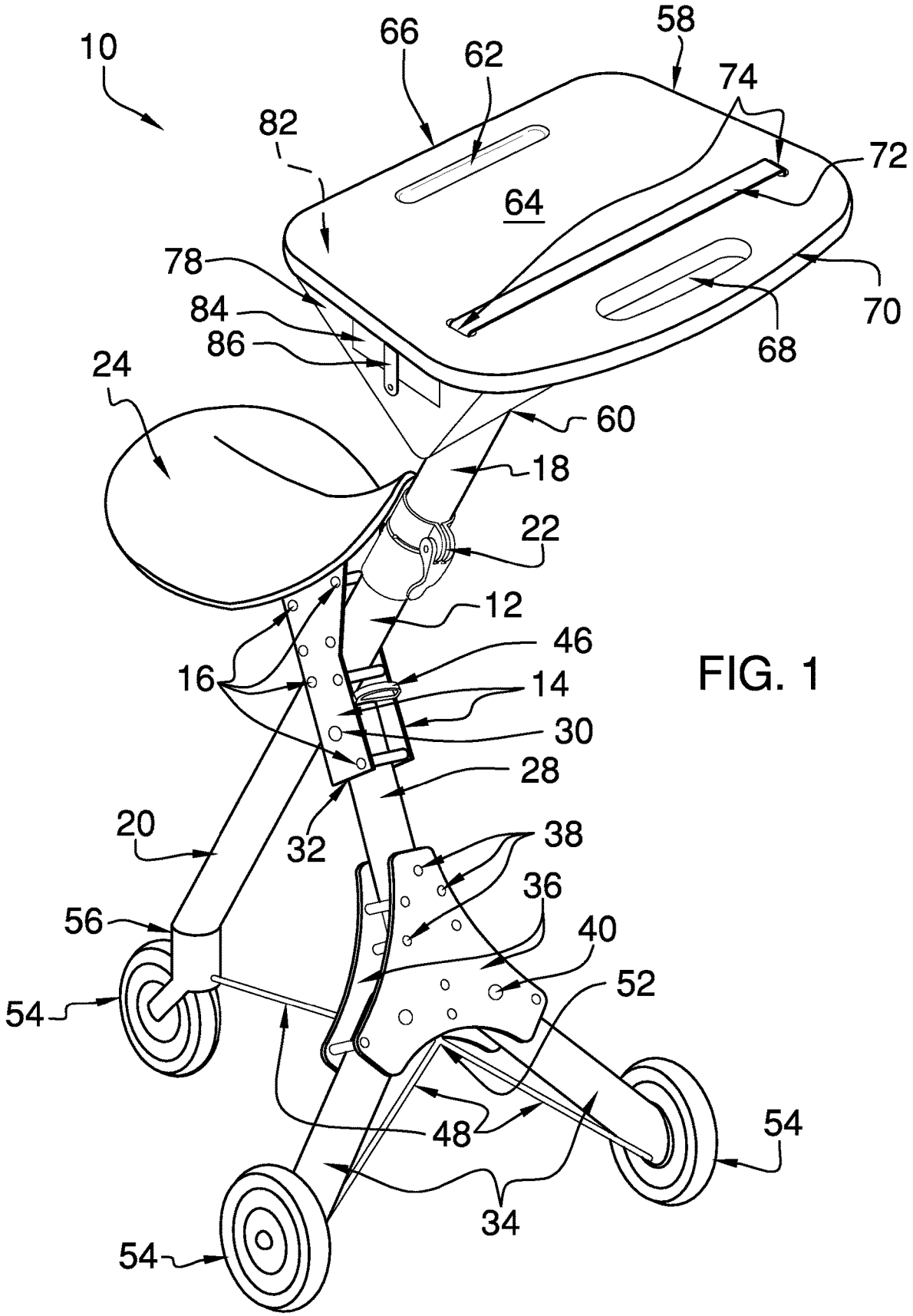
FIG. 1 is an isometric perspective view of a mobile desk assembly, in a deployed configuration, according to an embodiment of the disclosure.

With reference now to the drawings, and in particular to FIGS. 1 through 6 thereof, a new desk assembly embodying the principles and concepts of an embodiment of the disclosure and generally designated by the reference numeral 10 will be described.

As best illustrated in FIGS. 1 through 6, the mobile desk assembly 10 generally comprises a first leg 12, which is positioned between a pair of first plates 14. A plurality of first pins 16 is engaged to and extends between the first plates 14 so that the first plates 14 are engaged to, and bracket, the first leg 12. The first leg 12 comprises an upper section 18, which is selectively extensible from a lower section 20 so that the first leg 12 is selectively extendible. A fastener 22 is engaged to the upper section 18 of the first leg 12 and is selectively engageable to the lower section 20 to fixedly position the upper section 18 relative to the lower section 20.

A seat 24 is engaged to a first end 26 of the pair of first plates 14. The seat 24 is padded. The seat 24 is contoured so that the seat 24 is substantially complementary to buttocks of a user.

Figure 5:
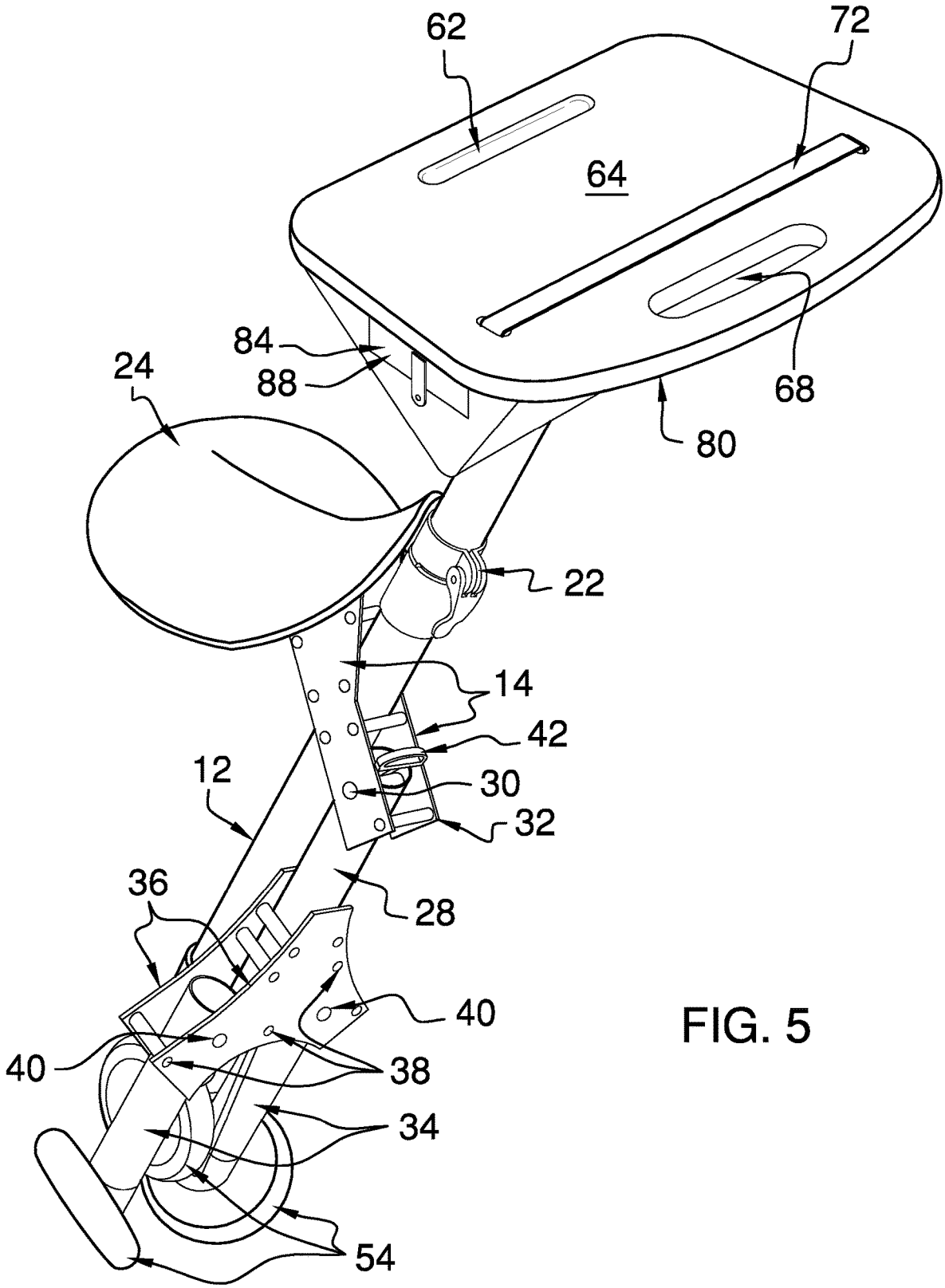
FIG. 5 is an isometric perspective view of an embodiment of the disclosure in a collapsed configuration.

A rod 28 is engaged via a first pivot pin 30 to the first plates 14, proximate a second end 32 thereof, so that the rod 28 is pivotally engaged to the first plates 14. The rod 28 is tubular. A pair of second legs 34 is hingedly engaged to the rod 28 distal from the pair of first plates 14. The first leg 12, the rod 28, and the second legs 34 are selectively positionable in a deployed configuration, as shown in FIG. 1, and a collapsed configuration, as shown in FIG. 5. In the deployed configuration, the rod 28 extends linearly from the pair of first plates 14 and the second legs 34 extend transversely from the rod 28. In the collapsed configuration, the second legs 34 extend in parallel from the rod 28 and the rod 28 is substantially parallel to the first leg 12.

Figure 2:
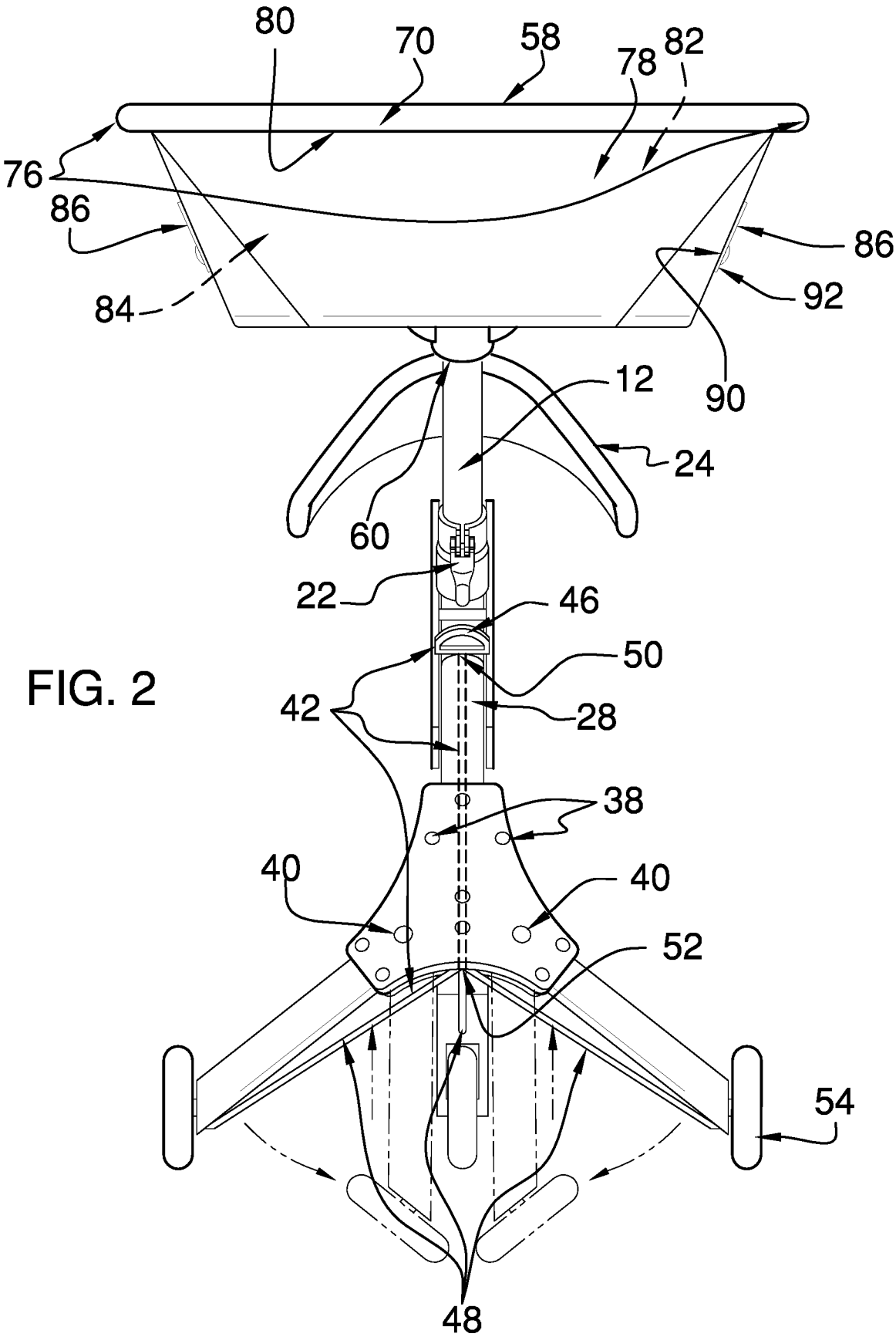
FIG. 2 is a front view of an embodiment of the disclosure.
Figure 3:
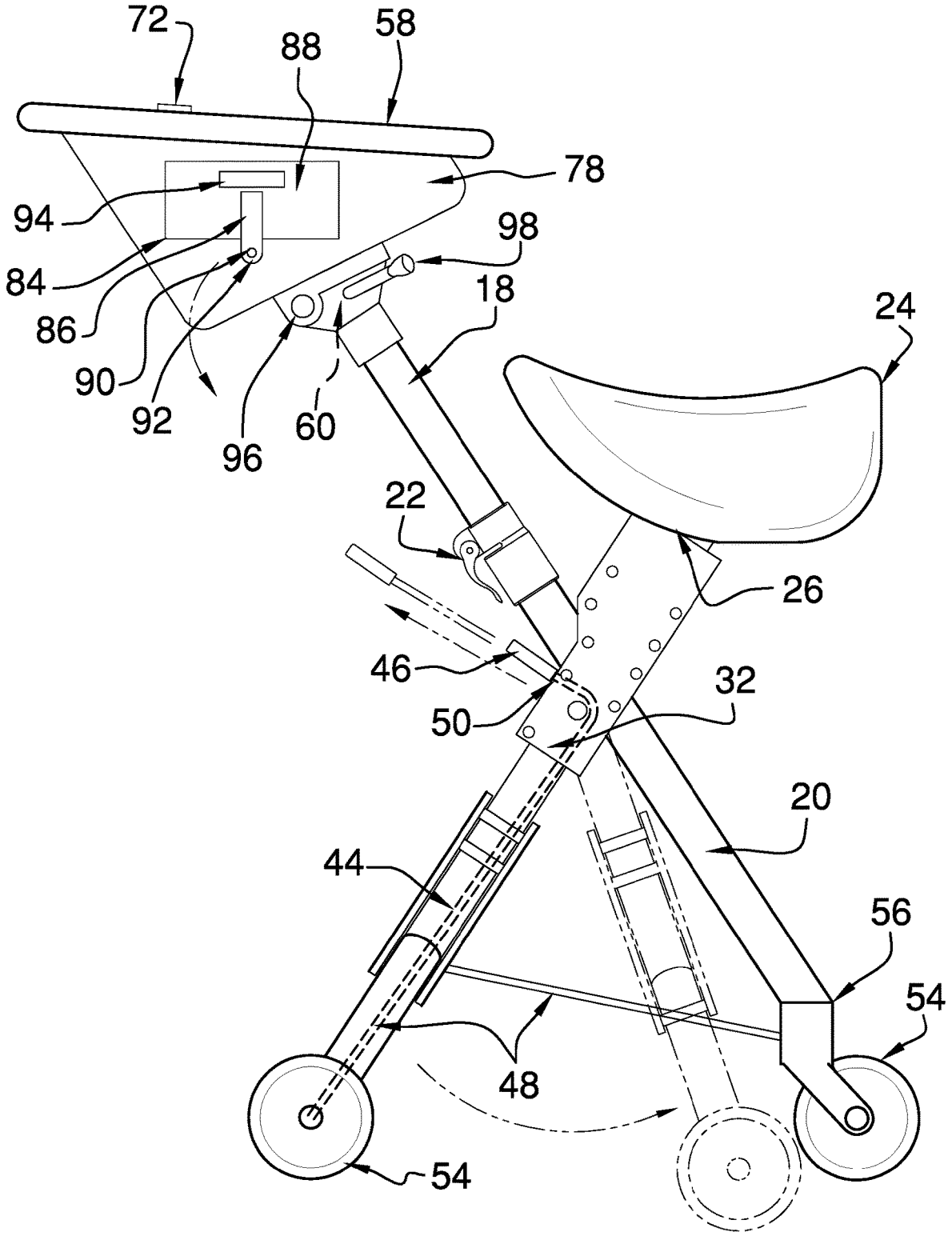
FIG. 3 is a side view of an embodiment of the disclosure.
Figure 4:
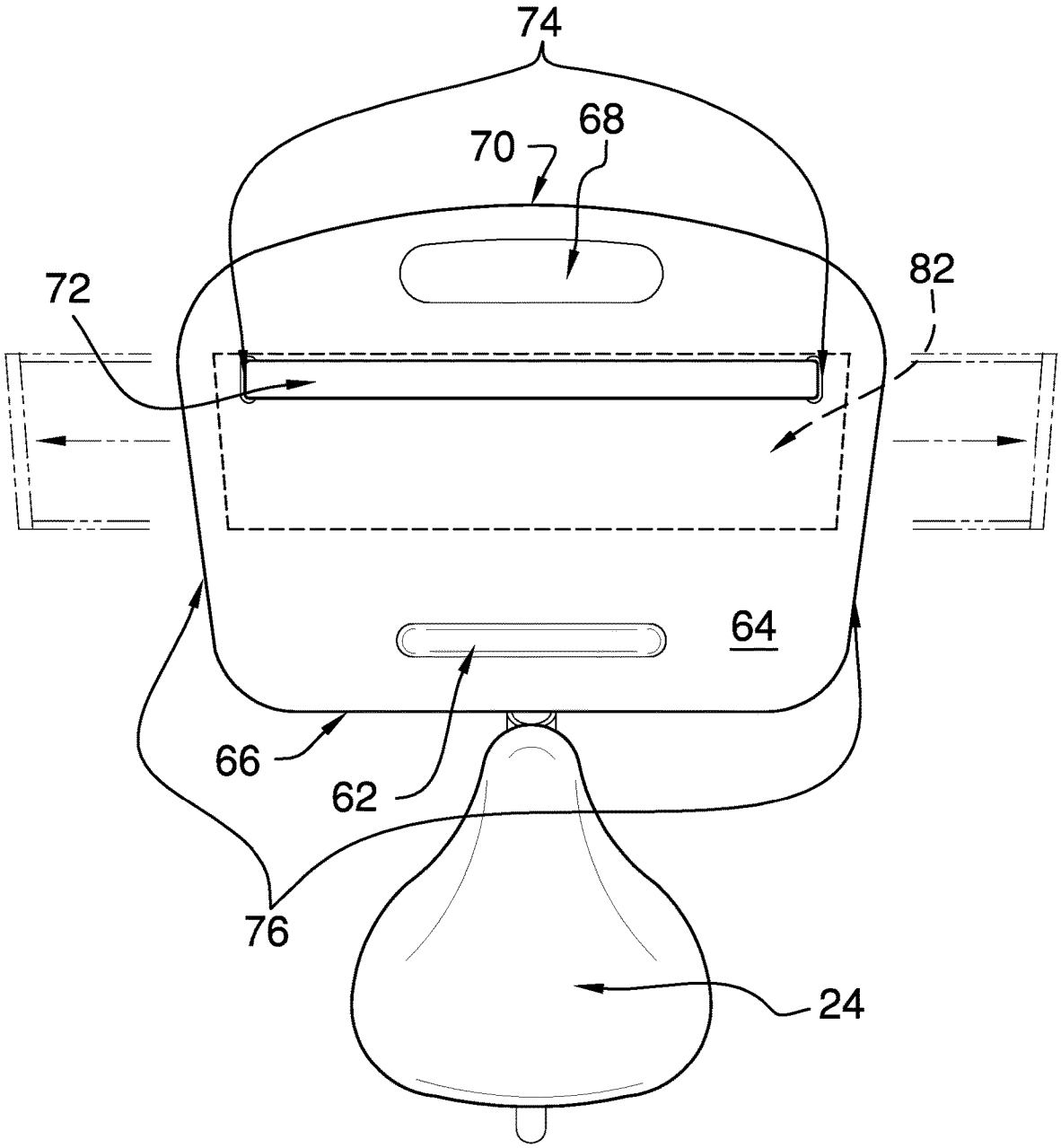
FIG. 4 is a top view of an embodiment of the disclosure.

A pair of second plates 36 is engaged to the rod 28 distal from the pair of first plates 14. A plurality of second pins 38 is engaged to and extends between the second plates 36 so that the second plates 36 are engaged to, and bracket, the rod 28. The second plates 36 are perpendicular to the first plates 14. Each second leg 34 is engaged by a respective second pivot pin 40 to the second plates 36 so that the second leg 34 is pivotally engaged to the second plates 36, as shown in FIG. 2.

An actuator 42 is operationally engaged to the rod 28, the second legs 34, and the first leg 12. The actuator 42 is positioned to selectively motivate the first leg 12, the rod 28, and the second legs 34 from the deployed configuration to the collapsed configuration. The actuator 42 comprises a first wire 44, a handle 46, and a set of second wires 48, as shown in FIG. 2. The first wire 44 extends through the rod 28. The handle 46 is engaged to a first endpoint 50 of the first wire 44. Each second wire 48 is engaged to and extends between a second endpoint 52 of the first wire 44 and a respective one of the first leg 12 and the second legs 34. The handle 46 is configured to be grasped in a hand of the user, positioning the user to pull on the first wire 44 to motivate the first leg 12, the rod 28, and the second legs 34 from the deployed configuration to the collapsed configuration.

The first leg 12 has a wheel 54 rotationally engaged thereto proximate to a lower terminus 56 thereof. Each second leg 34 has a wheel 54 rotationally engaged thereto distal from the rod 28. The wheels 54 are configured to allow locomotion across a surface.

A panel 58 is engaged to an upper terminus 60 of the first leg 12. The panel 58 is substantially parallel to the surface when the first leg 12, the rod 28, and the second legs 34 are in the deployed configuration. The panel 58 is rigid and thus is configured to have an article positioned upon an upper face 64 thereof. The panel 58 may be pivotally engaged to the first leg 12, via a third pivot pin 96, allowing the panel 58 to be pivoted relative to the first leg 12 for stowage. A lever 98 is engaged to the first leg 12 and is operationally engaged to the third pivot pin 96. The lever 98 is positioned to selectively lock the third pivot pin 96 to fixedly position the panel 58 relative to the first leg 12. The lever 98 is configured to be levered to reposition the panel 58 relative to the first leg 12 for stowage.

The panel 58 has an indentation 62 extending into the upper face 64 proximate to a rear edge 66 thereof. The indentation 62 is configured to position an item, such as a pen, to retain the item upon the panel 58. The panel 58 also has a cutout 68 positioned therein proximate to a front edge 70 thereof. The cutout 68 is configured for insertion of digits of a hand of the user. The user is positioned to pull on the panel 58 to effect locomotion upon the wheels 54.

Figure 6:
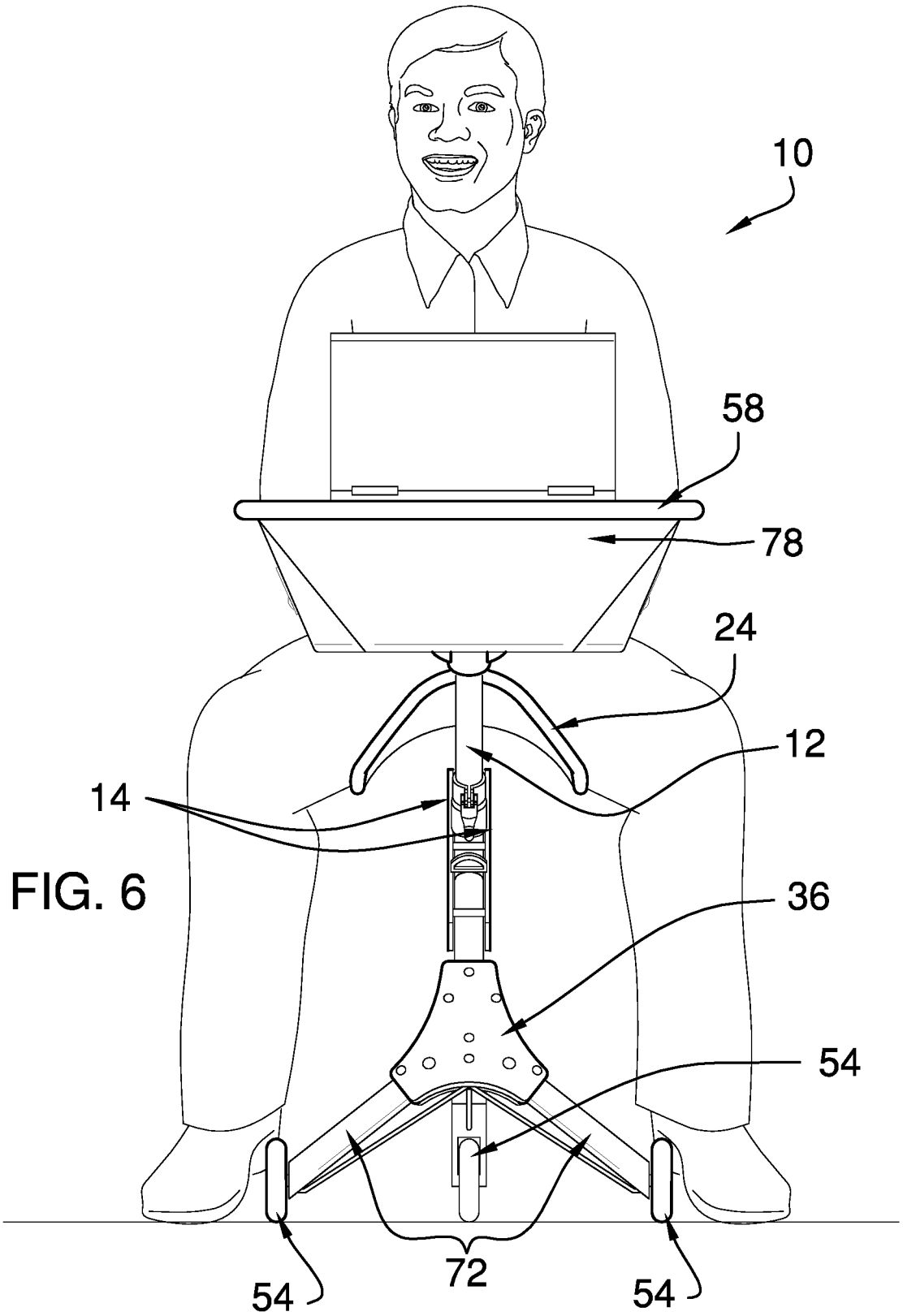
FIG. 6 is an in-use view of an embodiment of the disclosure.

The assembly 10 also comprises a strap 72, which has opposed ends 74. Each opposed end 74 is engaged to the panel 58 proximate to a respective opposed side 76 and the front edge 70 of the panel 58. The strap 72 is resiliently stretchable so that the strap 72 and the panel 58 are configured for insertion of an element of the article therebetween so that the article is engaged to the panel 58. For example, as shown in FIG. 6, an open laptop computer can be inserted between the strap 72 and the panel 58 to engage the laptop computer to the panel 58. The strap 72 comprises rubber, silicone, or elastomer.

A shell 78 is engaged to a lower face 80 of the panel 58 so that the shell 78 and the panel 58 define an interior space 82. A drawer 84 is engaged to the shell 78 and is selectively extendible from the interior space 82. A grasp 94 engaged to an outer surface 88 of the drawer 84 is configured to be grasped in digits of the hand of the user to open the drawer 84.

A strip 86 is engaged to the shell 78 proximate to the drawer 84. The strip 86 is extendible over the outer face 88 of the drawer 84 when the drawer 84 is positioned in the interior space 82. A first connector 90 is engaged to the shell 78 proximate to the drawer 84. A second connector 92 is engaged to the strip 86 distal from the shell 78. The second connector 92 is complementary to the first connector 90 so that the second connector 92 is positioned to selectively engage the first connector 90. The strip 86 is fixedly positioned over the outer face 88 of the drawer 84 to retain the drawer 84 in the interior space 82. The second connector 92 and the first connector 90 may comprise a snap closure, hook and loop fastener, or the like.

In use, the assembly 10 is transported in the collapsed configuration to a work location. The first leg 12, the second legs 34, and the rod 28 are motivated to the deployed configuration wherein the user can be seated upon the seat 24. The user can locomote the assembly 10 upon the wheels 54 using their legs and feet, when seated, or by inserting the digits of their hand into the cutout 68 and pulling the assembly 10 across the surface. The panel 58 is available for positioning of articles, such as note pads, clip boards, laptop computers, and the like. Miscellaneous items can be stowed in the drawer 84. To revert to the collapsed configuration, the user simply pulls on the handle 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A mobile desk assembly comprising:

a pair of first plates;

a first leg positioned between the pair of first plates, the first leg having a wheel rotationally engaged thereto proximate to a lower terminus thereof;

a plurality of first pins engaged to and extending between the first plates, such that the first plates are engaged to and bracket the first leg;

a seat engaged to a first end of the pair of first plates;

a rod engaged via a first pivot pin to the first plates, proximate a second end thereof, such that the rod is pivotally engaged to the first plates;

a pair of second legs hingedly engaged to the rod distal from pair of first plates, such that the first leg, the rod, and the second legs are selectively positionable in a deployed configuration, wherein the rod extends linearly from the pair of first plates and the second legs extend transversely from the rod, and a collapsed configuration, wherein the second legs extend in parallel from the rod and the rod is substantially parallel to the first leg, each second leg having a wheel rotationally engaged thereto distal from the rod, wherein the wheels are configured for locomotion across a surface; and a panel engaged to an upper terminus of the first leg, such that the panel is substantially parallel to the surface when the first leg, the rod, and the second legs are in the deployed configuration, the panel being rigid, wherein the panel is configured for positioning of an article upon an upper face thereof.

2. The mobile desk assembly of claim 1, further including:

the first leg comprising an upper section selectively extensible from a lower section, such that the first leg is selectively extendible; and a fastener engaged to the upper section of the first leg and being selectively engageable to the lower section for fixedly positioning the upper section relative to the lower section.

3. The mobile desk assembly of claim 1, wherein the seat is padded.

4. The mobile desk assembly of claim 1, wherein the seat is contoured such that seat is substantially complementary to buttocks of a user.

5. The mobile desk assembly of claim 1, further including:

a pair of second plates engaged to the rod distal from the pair of first plates; and a plurality of second pins engaged to and extending between the second plates, such that the second plates are engaged to and bracket the rod, and such that the second plates are perpendicular to the first plates, each second leg being engaged by a respective second pivot pin to the second plates, such that the second leg is pivotally engaged to the second plates.

6. The mobile desk assembly of claim 5, further including:

a third pivot pin engaged to the panel and the first leg, such that the panel is selectively pivotable relative to the first leg for stowage; and a lever engaged to the first leg and being operationally engaged to the third pivot pin, such that the lever is positioned for selectively locking the third pivot pin for fixedly positioning the panel relative to the first leg, wherein the lever is configured for levering for repositioning the panel relative to the first leg for stowage.

7. The mobile desk assembly of claim 1, further including an actuator operationally engaged to the rod, the second legs, and the first leg, such that the actuator is positioned for selectively motivating the first leg, the rod, and the second legs from the deployed configuration to the collapsed configuration.

8. The mobile desk assembly of claim 7, wherein:

the rod is tubular; and the actuator comprises:

a first wire extending through the rod, a handle engaged to a first endpoint of the first wire, and a set of second wires, each second wire being engaged to and extending between a second endpoint of the first wire and a respective one of the first leg and the second legs, wherein the handle is configured for grasping in a hand of a user, positioning the user for pulling on the first wire for motivating the first leg, the rod, and the second legs from the deployed configuration to the collapsed configuration.

9. The mobile desk assembly of claim 1, wherein the panel has an indentation extending into the upper face proximate to a rear edge thereof, wherein the indentation is configured for positioning of an item for retaining the item upon the panel.

10. The mobile desk assembly of claim 1, wherein the panel has a cutout positioned therein proximate to a front edge thereof, wherein the cutout is configured for insertion of digits of a hand of a user, positioning the user for pulling on the panel for effecting locomotion upon the wheels.

11. The mobile desk assembly of claim 1, further including a strap having opposed ends, each opposed end being engaged to the panel proximate to a respective opposed side and a front edge of the panel, the strap being resiliently stretchable, wherein the strap and the panel are configured for insertion of an element of the article therebetween, such that the article is engaged to the panel.

12. The mobile desk assembly of claim 1, wherein the panel the strap comprises rubber, silicone, or elastomer.

13. The mobile desk assembly of claim 1, further including:

a shell engaged to a lower face of the panel, such that the shell and the panel define an interior space;

a drawer engaged to the shell and being selectively extendible from the interior space; and a grasp engaged to an outer surface of the drawer and being configured for grasping in digits of the hand of the user for opening the drawer.

14. The mobile desk assembly of claim 13, further including:

a strip engaged to the shell proximate to the drawer, such that the strip is extendible over an outer face of the drawer when the drawer is positioned in the interior space;

a first connector engaged to the shell proximate to the drawer; and a second connector engaged to the strip distal from the shell, the second connector being complementary to the first connector, such that the second connector is positioned for selectively engaging the first connector, such that the strip is fixedly positioned over the outer face of the drawer for retaining the drawer in the interior space.

15. A mobile desk assembly comprising:

a pair of first plates;

a first leg positioned between the pair of first plates, the first leg having a wheel rotationally engaged thereto proximate to a lower terminus thereof, the first leg comprising an upper section selectively extensible from a lower section, such that the first leg is selectively extendible;

a fastener engaged to the upper section of the first leg and being selectively engageable to the lower section for fixedly positioning the upper section relative to the lower section;

a plurality of first pins engaged to and extending between the first plates, such that the first plates are engaged to and bracket the first leg;

a seat engaged to a first end of the pair of first plates, the seat being padded, the seat being contoured such that the seat is substantially complementary to buttocks of a user;

a rod engaged via a first pivot pin to the first plates, proximate a second end thereof, such that the rod is pivotally engaged to the first plates, the rod being tubular;

a pair of second legs hingedly engaged to the rod distal from pair of first plates, such that the first leg, the rod, and the second legs are selectively positionable in a deployed configuration, wherein the rod extends linearly from the pair of first plates and the second legs extend transversely from the rod, and a collapsed configuration, wherein the second legs extend in parallel from the rod and the rod is substantially parallel to the first leg, each second leg having a wheel rotationally engaged thereto distal from the rod, wherein the wheels are configured for locomotion across a surface;

a pair of second plates engaged to the rod distal from the pair of first plates;

a plurality of second pins engaged to and extending between the second plates, such that the second plates are engaged to and bracket the rod, and such that the second plates are perpendicular to the first plates, each second leg being engaged by a respective second pivot pin to the second plates, such that the second leg is pivotally engaged to the second plates;

an actuator operationally engaged to the rod, the second legs, and the first leg, such that the actuator is positioned for selectively motivating the first leg, the rod, and the second legs from the deployed configuration to the collapsed configuration, the actuator comprising:

a first wire extending through the rod, a handle engaged to a first endpoint of the first wire, and a set of second wires, each second wire being engaged to and extending between a second endpoint of the first wire and a respective one of the first leg and the second legs, wherein the handle is configured for grasping in a hand of the user, positioning the user for pulling on the first wire for motivating the first leg, the rod, and the second legs from the deployed configuration to the collapsed configuration;

a panel engaged to an upper terminus of the first leg, such that the panel is substantially parallel to the surface when the first leg, the rod, and the second legs are in the deployed configuration, the panel being rigid, wherein the panel is configured for positioning of an article upon an upper face thereof, the panel having an indentation extending into the upper face proximate to a rear edge thereof, wherein the indentation is configured for positioning of an item for retaining the item upon the panel, the panel having a cutout positioned therein proximate to a front edge thereof, wherein the cutout is configured for insertion of digits of a hand of the user, positioning the user for pulling on the panel for effecting locomotion upon the wheels;

a third pivot pin engaged to the panel and the first leg, such that the panel is selectively pivotable relative to the first leg for stowage;

a lever engaged to the first leg and being operationally engaged to the third pivot pin, such that the lever is positioned for selectively locking the third pivot pin for fixedly positioning the panel relative to the first leg, wherein the lever is configured for levering for repositioning the panel relative to the first leg for stowage;

a strap having opposed ends, each opposed end being engaged to the panel proximate to a respective opposed side and the front edge of the panel, the strap being resiliently stretchable, wherein the strap and the panel are configured for insertion of an element of the article therebetween, such that the article is engaged to the panel, the strap comprising rubber, silicone, or elastomer;

a shell engaged to a lower face of the panel, such that the shell and the panel define an interior space;

a drawer engaged to the shell and being selectively extendible from the interior space;

a grasp engaged to an outer surface of the drawer and being configured for grasping in digits of the hand of the user for opening the drawer;

a strip engaged to the shell proximate to the drawer, such that the strip is extendible over the outer face of the drawer when the drawer is positioned in the interior space;

a first connector engaged to the shell proximate to the drawer; and a second connector engaged to the strip distal from the shell, the second connector being complementary to the first connector, such that the second connector is positioned for selectively engaging the first connector, such that the strip is fixedly positioned over the outer face of the drawer for retaining the drawer in the interior space.

* * * * *